US008730542B2

(12) United States Patent
Nakamura

(10) Patent No.: US 8,730,542 B2
(45) Date of Patent: May 20, 2014

(54) SHEET FEEDING DEVICE

(71) Applicant: Kazutoshi Nakamura, Kuwana (JP)

(72) Inventor: Kazutoshi Nakamura, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/744,491

(22) Filed: Jan. 18, 2013

(65) Prior Publication Data

US 2013/0182299 A1 Jul. 18, 2013

(30) Foreign Application Priority Data

Jan. 18, 2012 (JP) ..... 2012-008225

(51) Int. Cl.
*H04N 1/04* (2006.01)

(52) U.S. Cl.
USPC ..... 358/498; 358/497; 358/474; 399/367; 271/278; 271/3.14

(58) Field of Classification Search
CPC ..... H04N 1/00602; H04N 1/00631; H04N 1/00567; H04N 1/0057; H04N 1/00628; H04N 1/0062; H04N 1/12; B65H 3/06; B65H 3/5261; B65H 9/166
USPC ..... 358/498, 474, 497, 496, 486; 399/361, 399/130, 367, 357; 271/126, 314, 220, 271/3.01, 3.14, 8.01, 278
See application file for complete search history.

(56) References Cited

U.S. PATENT DOCUMENTS

| | | | | | |
|---|---|---|---|---|---|
| 5,078,379 | A * | 1/1992 | Leisner | ..... | 271/3.04 |
| 5,532,839 | A * | 7/1996 | Beikirch et al. | ..... | 358/401 |
| 5,537,227 | A * | 7/1996 | Samii et al. | ..... | 358/498 |
| 5,978,622 | A * | 11/1999 | Wenthe, Jr. | ..... | 399/98 |
| 7,672,026 | B2 * | 3/2010 | Kawai et al. | ..... | 358/498 |
| 8,098,411 | B2 * | 1/2012 | Iwago et al. | ..... | 358/498 |
| 8,103,186 | B2 * | 1/2012 | Andoh et al. | ..... | 399/110 |
| 8,120,821 | B2 * | 2/2012 | Ishida et al. | ..... | 358/474 |
| 8,373,911 | B2 * | 2/2013 | Iwata et al. | ..... | 358/474 |

FOREIGN PATENT DOCUMENTS

| | | | |
|---|---|---|---|
| JP | 63-11443 | U | 1/1988 |
| JP | 4-023741 | A | 1/1992 |
| JP | 6-227693 | A | 8/1994 |
| JP | 11-059934 | A | 3/1999 |

* cited by examiner

*Primary Examiner* — Negussie Worku
(74) *Attorney, Agent, or Firm* — Banner & Witcoff, Ltd.

(57) ABSTRACT

A sheet feeding device including a roller to apply conveying force to one of a plurality of stacked sheets, a separator piece to apply conveying resistance to the stacked sheets and to nip the one of the stacked sheets in cooperation with the roller, a movable member being movable with respect to the roller, a pair of spring arms configured to contact the stacked sheets at an upstream position along a conveying direction with respect to a nipping position between the roller and the separator piece, and a bridge to bridge between the pair of spring arms, is provided. The bridge and the movable member are slidably in contact with each other at least when the sheet feeding device is in a conveyable condition.

8 Claims, 8 Drawing Sheets

SHEET FEEDING DEVICE

CROSS REFERENCE TO RELATED APPLICATION

This application claims priority from Japanese Patent Application No. 2012-008225, filed on Jan. 18, 2012, the entire subject matter of which is incorporated herein by reference.

BACKGROUND

1. Technical Field

An aspect of the present invention relates to a sheet feeding device capable of separating a plurality of stacked sheets individually and conveying the separated sheets one-by-one in a predetermined direction.

2. Related Art

A sheet feeding device, in which a plurality of stacked sheets are separated one-by-one by a roller and a separator pad and conveyed in a predetermined direction, is known. In the sheet feeding device, idle feeding of the sheets can be prevented by a pair of auxiliary blade springs, which press the sheets against the roller.

SUMMARY

When such a sheet feeding device is in use, vibration may be caused in a holder frame holding the separator pad and in the auxiliary blade springs, and the vibration may produce undesirable noise.

In view of the inconvenience, the present invention is advantageous in that a sheet feeding device, which can reduce the noise, is provided.

According to an aspect of the present invention, a sheet feeding device configured to separate a plurality of stacked sheets and convey the separated sheets individually along a conveying direction is provided. The sheet feeding device includes a roller arranged to be in contact with one of the stacked sheets and configured to rotate on the one of the stacked sheets to apply conveying force to the one of the stacked sheets by rotation; a separator piece arranged to face the roller and configured to contact the stacked sheets to apply conveying resistance to the stacked sheets and to nip the one of the stacked sheets together with the roller; a movable member arranged on an opposite side from the roller across the separator piece and configured to be movable with respect to the roller; a pair of spring arms configured to contact the stacked sheets at an upstream position along the conveying direction with respect to a nipping position between the roller and the separator piece to press the stacked sheets toward the roller, each of the spring arms arranged on either side of the separator piece along a widthwise direction, the widthwise direction being orthogonal to the conveying direction, to extend along the conveying direction; and a bridge configured to bridge between the pair of spring arms to connect the paired spring arms. The bridge and the movable member are slidably in contact with each other at least when the sheet feeding device is in a conveyable condition, in which the stacked sheets are conveyable.

According to another aspect of the present invention, an image reading apparatus, including a reader unit configured to read an image appearing on an original sheet, and a sheet feeding device configured to separate a plurality of stacked original sheets and convey the separated sheets individually along a conveying direction to the reader unit, is provided. The sheet feeding device includes a roller arranged to be in contact with one of the stacked sheets and configured to rotate on the one of the stacked sheets to apply conveying force to the one of the stacked sheets by rotation; a separator piece arranged to face the roller and configured to contact the stacked sheets to apply conveying resistance to the stacked sheets and to nip the one of the stacked sheets in cooperation with the roller; a movable member arranged on an opposite side from the roller across the separator piece and configured to be movable with respect to the roller; a pair of spring arms configured to contact the stacked sheets at an upstream position along the conveying direction with respect to a nipping position between the roller and the separator piece to press the stacked sheets toward the roller, each of the spring arms arranged on either side of the separator piece along a widthwise direction, the widthwise direction being orthogonal to the conveying direction, to extend along the conveying direction; and a bridge configured to bridge between the pair of spring arms to connect the paired spring arms. The bridge and the movable member are slidably in contact with each other at least when the sheet feeding device is in a conveyable condition, in which the stacked sheets are conveyable.

BRIEF DESCRIPTION OF THE ACCOMPANYING DRAWINGS

DETAILED DESCRIPTION

Hereinafter, an embodiment of the present invention will be described with reference to the accompanying drawings. It is noted that various connections are set forth between elements in the following description. These connections in general, and unless specified otherwise, may be direct or indirect, and this specification is not intended to be limiting in this respect.

1. Overall Configuration of the MFP

Figure 1:
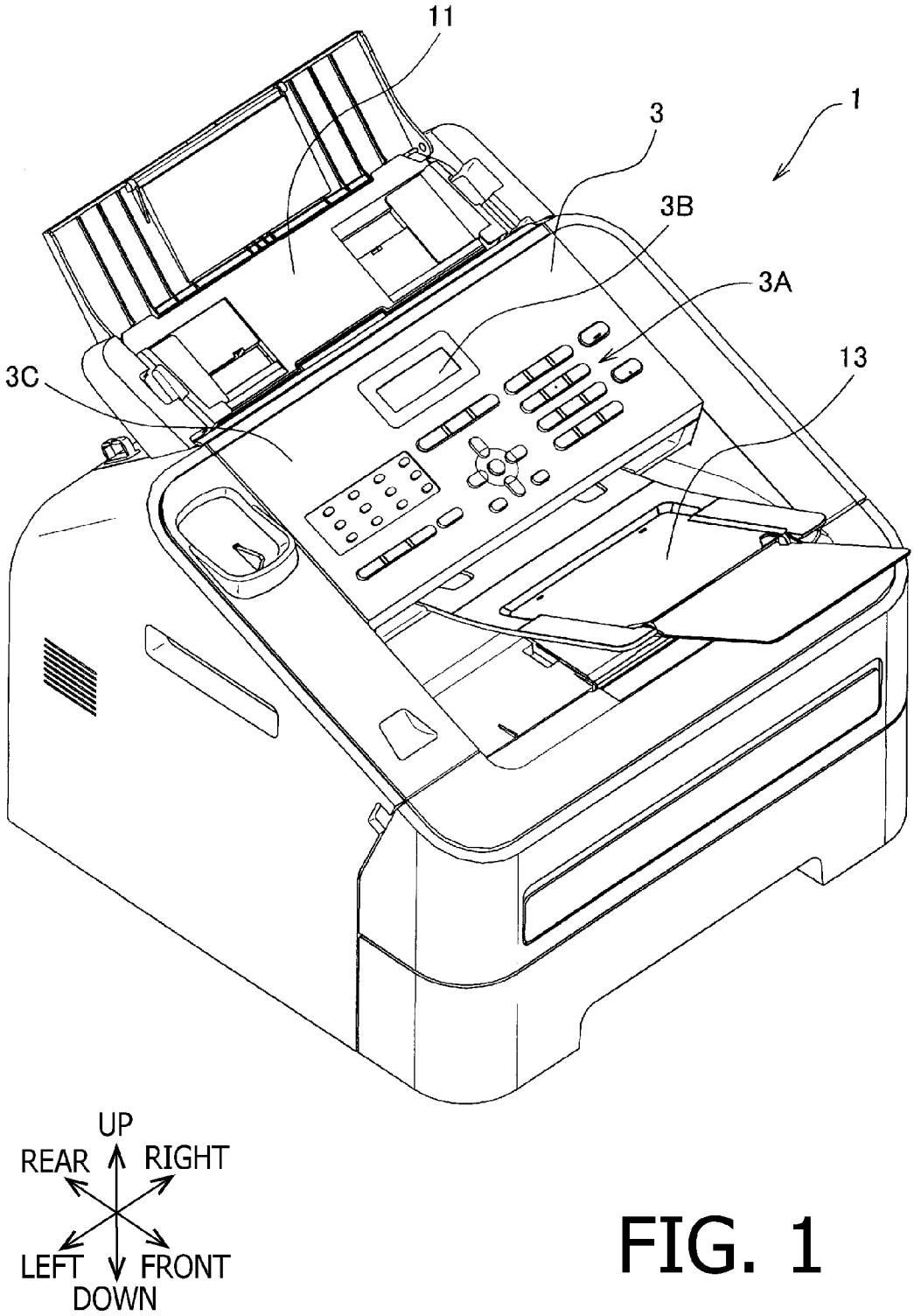
FIG. 1 is a perspective view of a multifunction peripheral device (MFP) according to an embodiment of the present invention.

An overall configuration of the MFP 1 according to the embodiment will be described with reference to FIG. 1. The MFP 1 is a multifunction peripheral device equipped with a plurality of functions, which include a facsimile transmission/receiving function, a copier function, and a printing function. In the embodiment described below, directions concerning the MFP 1 will be referred to based on a user's position to ordinarily use the MFP 1 and in accordance with orientation indicated by arrows in each drawings. That is, for example, a viewer's lower right appearing in FIG. 1 is referred to as front of the MFP 1. An upper left in FIG. 1 opposite from the front is referred to as rear. A side, which corresponds to the viewer's lower-left side is referred to as a left-side face, and an opposite side from the left, which corresponds to the viewer's upper-right side, is referred to as a right-side face of the MFP 1. The up-down direction in FIG. 1 corresponds to a vertical direction of the MFP 1.

The MFP 1, as shown in FIG. 1, is formed to have an inclined upper surface 3. On the inclined surface 3, an operation panel 3C including an operation unit 3A and a display unit 3B is provided. The operation unit 3A is touched or pressed by a user when the user uses one of the functions in the MFP 1. The display unit 3B displays information, which is to be provided to the user, concerning the functions in the MFP 1.

Figure 2:
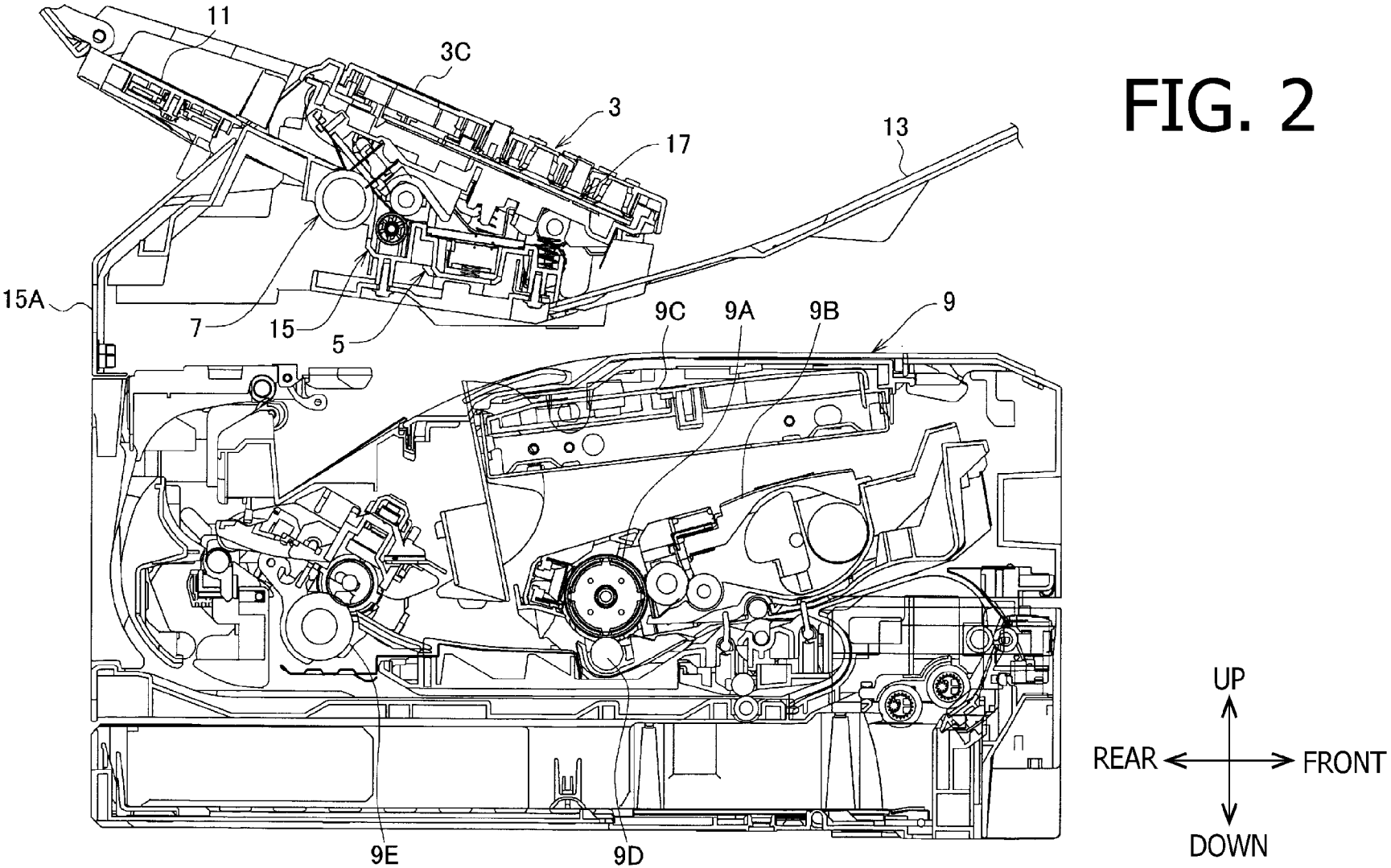
FIG. 2 is a cross-sectional side view of the MFP according to the embodiment of the present invention.

In a lower position with respect to the operation panel 3C, as shown in FIG. 2, a reader unit 5 to read images, including figures and characters, from an original sheet, is disposed. The reader unit 5 is activated when the facsimile function or the copier function is used. The MFP 1 is equipped with an auto-feeder unit 7, which is configured to convey and feed the original sheet to the reader unit 5.

In a lower position with respect to the reader unit 5 and the auto-feeder unit 7, via clearance, an image forming unit 9 to form images on a recording sheet is disposed. The image forming unit 9 forms images on a recording sheet based on print data, which is received in the MFP 1 via telephone lines or transmitted from an external device such as a computer.

The image forming unit 9 in the present embodiment forms images in an electrophotographic method, in which a developer agent is transferred onto a surface of the recording sheet from a transfer medium. More specifically, the image forming unit 9 includes a developer unit 9B having a photosensitive drum 9A, an exposure device 9C to expose the photosensitive drum 9A to emitted light, a transfer roller 9D to transfer developer agent carried on the photosensitive drum 9A to the recording sheet, and a fixing device 9E to fix the transferred image on the recording sheet thereat by heat.

2. Structure of Auto-Feeder Unit 2.1 Overall Configuration of the Auto-Feeder Unit and the Reader Unit The overall configuration of the auto-feeder unit and the reader unit will be described hereinbelow. The auto-feeder unit 7 is disposed in an upstream position with respect to the reader unit 5 along a direction of conveying the original sheet. In the present embodiment, the original sheet is picked up from an original sheet tray 11, which is disposed on a rear side of the MFP 1, to be conveyed toward an ejection tray 13, which is disposed on a front side of the MFP 1.

Figure 3:
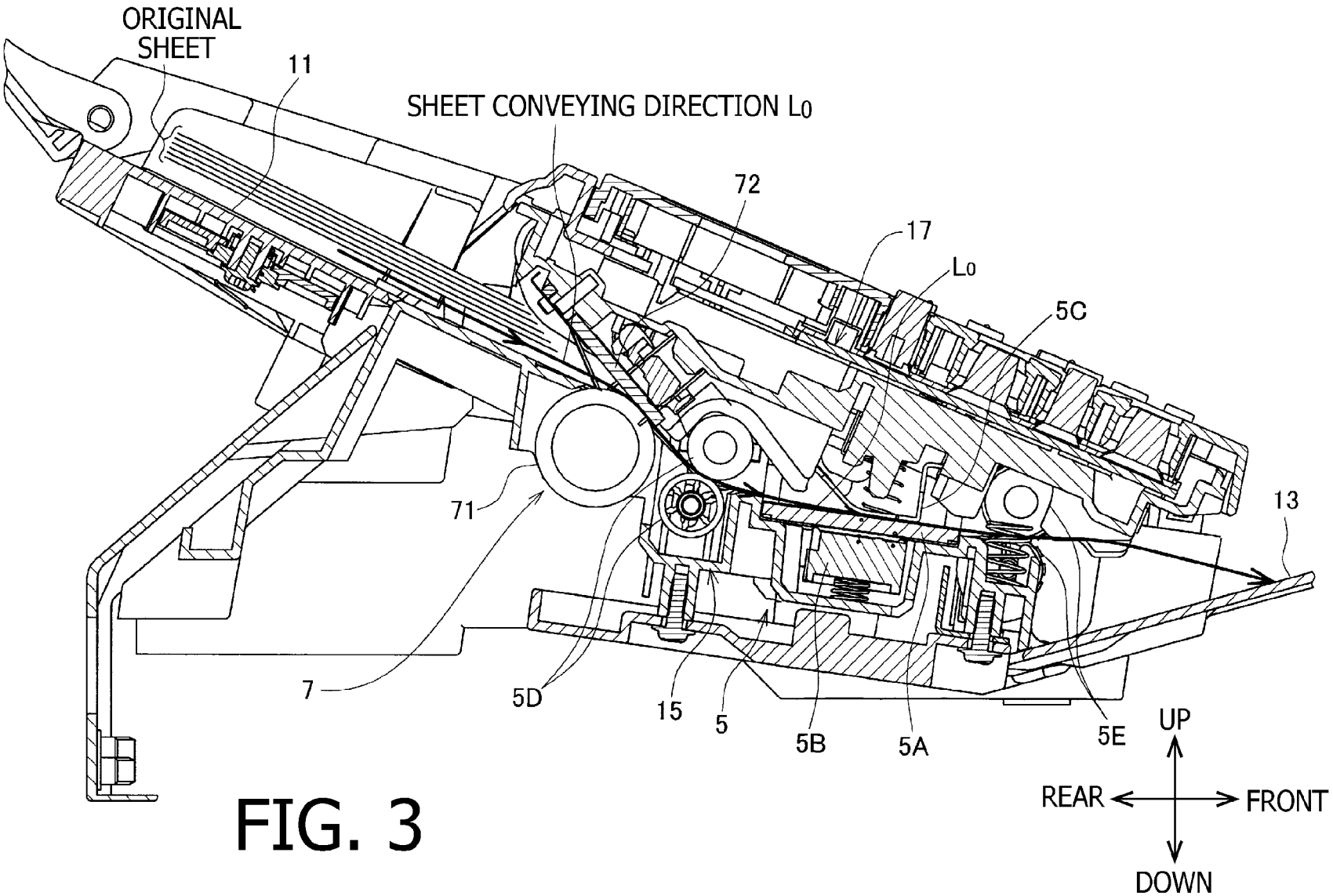
FIG. 3 is a cross-sectional side view of an auto-feeder unit and a reader unit in the MFP according to the embodiment of the present invention.

In order to pick up and convey the original sheets, as shown in FIG. 3, the auto-feeder unit 7 separates a plurality of original sheets stacked on the original sheet tray 11 individually and feeds the separated original sheets one-by-one to the reader unit 5. The reader unit 5 conveys the original sheets fed by the auto-feeder unit 7 farther toward the ejection tray 13 and reads the images appearing on the original sheets while the original sheets are being conveyed. The original sheets having been read are stacked one after another on the ejection tray 13.

The reader unit 5 includes a platen 5*a*, an image reading element 5B, a sheet presser 5C, a pair of conveyer rollers 5D, and a pair of conveyer rollers 5E. The platen 5A supports the original sheet from below and is made of a transparent material. The image reading element 5B is a contact image sensor (CIS), which converts reflection of light on the original sheet into electrical signals.

The sheet presser 5C presses the original sheet having been conveyed against the platen 5A. The pair of conveyer rollers 5D are disposed in upstream positions with respect to the platen 5A along the conveying direction and convey the original sheet farther toward downstream. The pair of conveyer rollers 5E are disposed in downstream positions with respect to the platen 5A along the conveying direction and convey the original sheet farther toward downstream.

In the MFP 1, a conveying path Lo is formed with a base piece 15, which is arranged on one side of the conveying path Lo, and a panel 17, which is arranged on the other side of the conveying path Lo. In other word, the conveying path Lo is formed in between the base piece 15 and the panel 17, which are arranged to oppose to each other along a direction orthogonal to the original sheet being conveyed. In the present embodiment, the direction orthogonal to the original sheet being conveyed coincides with a direction, which intersects a horizontal direction. In other words, the direction orthogonal to the original sheet being conveyed coincides substantially with the vertical direction.

Figure 4:
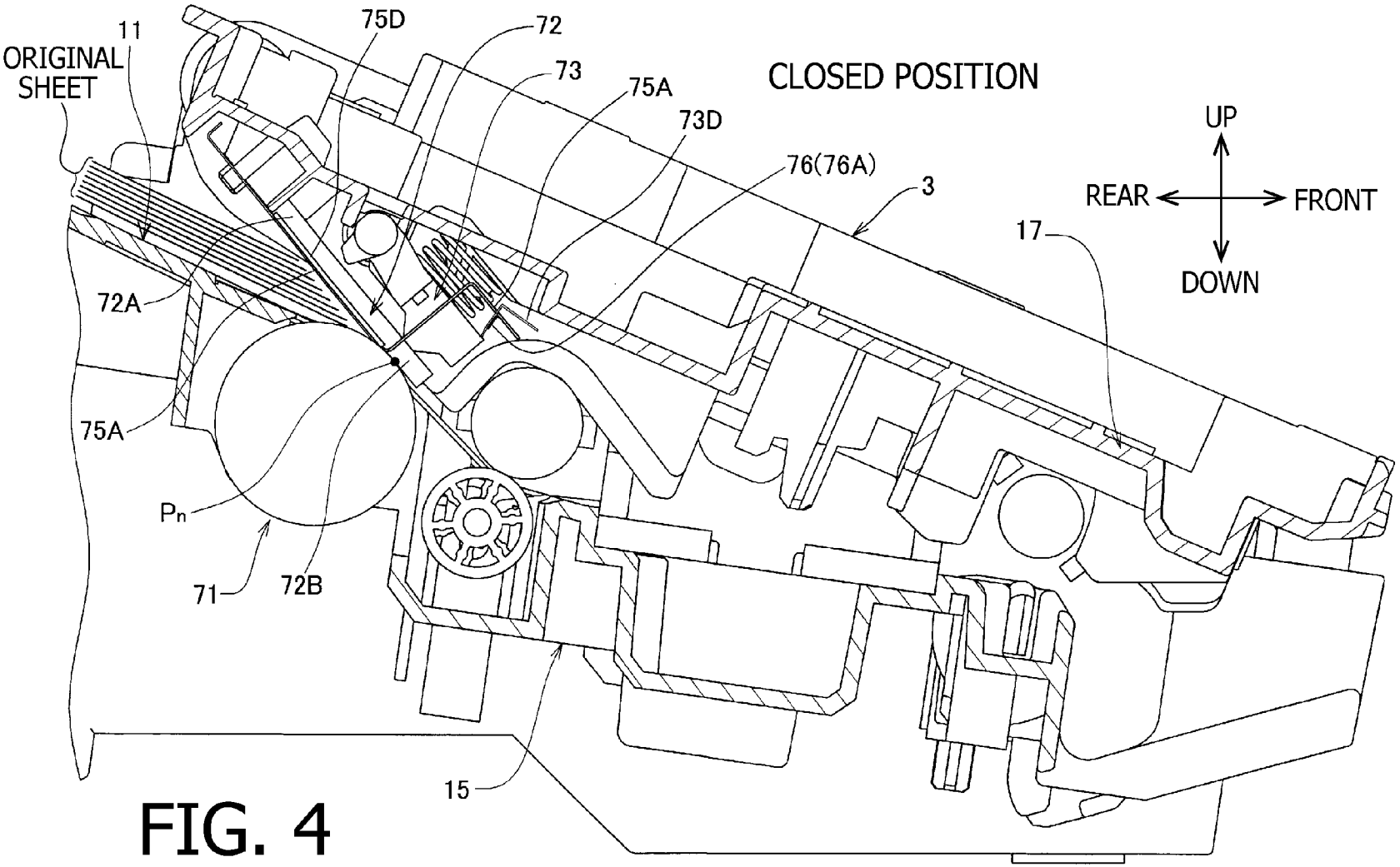
FIG. 4 is a cross-sectional side view of the auto-feeder unit in a closed position in the MFP according to the embodiment of the present invention.
Figure 5:
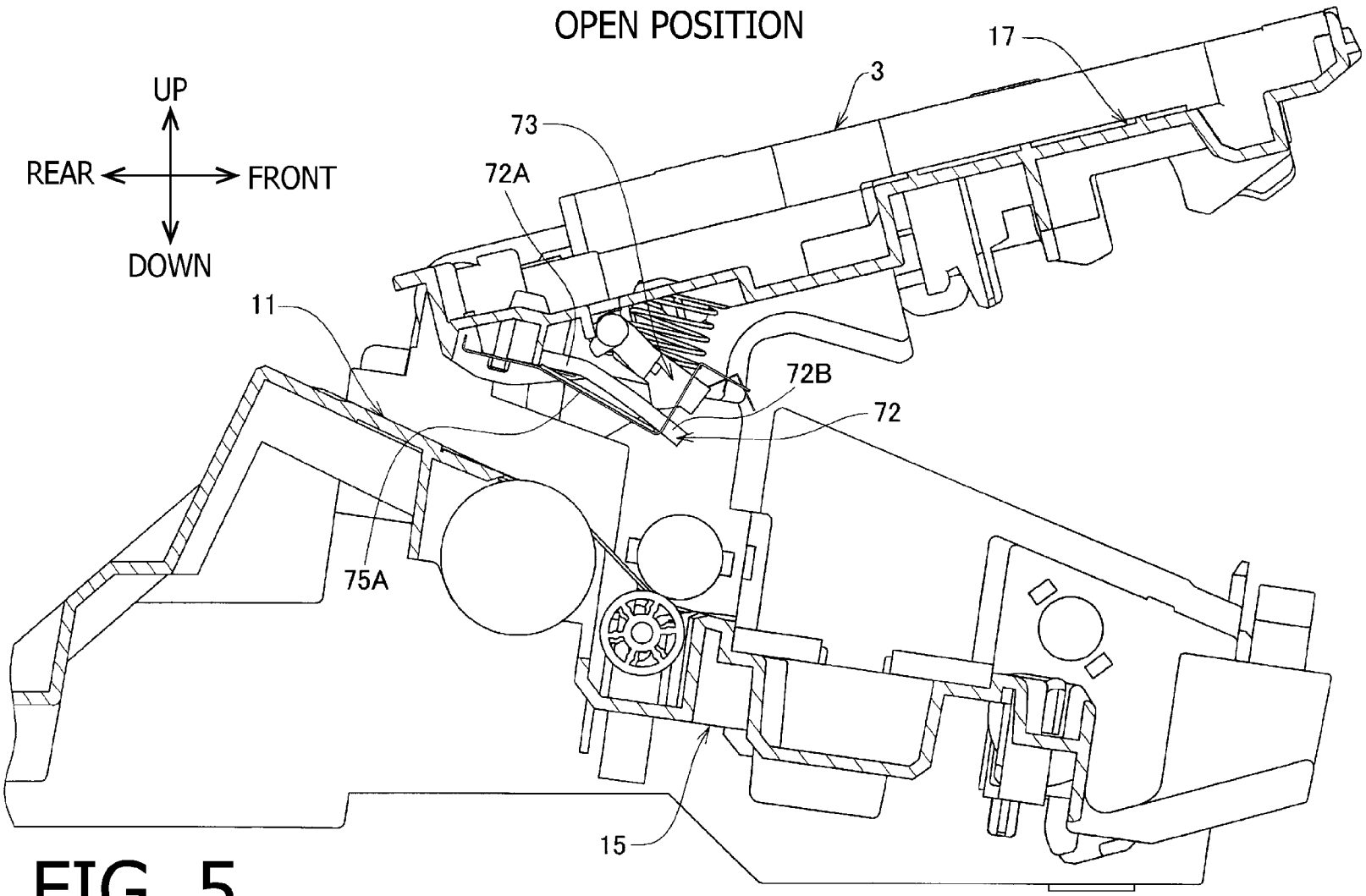
FIG. 5 is a cross-sectional view of the auto-feeder unit in an open position in the MFP according to the embodiment of the present invention.

The base piece 15 is, as shown in FIG. 2, fixed to the image forming unit 9 via a joint 15A. The panel 17 is swingably attached to the base piece 15 to swing closely to and apart from the base piece 15. More specifically, the panel 17 is movable between a closed position (see FIG. 4), in which the panel 17 is in adjacent to the base piece 15 to cover the conveying path Lo, and an open position (see FIG. 5), in which the panel 17 is apart from the base piece 15 to expose the conveying path Lo.

In the reader unit 5, the platen 5A, the image reading element 5B, one of the paired conveyer rollers 5D, and one of the paired conveyer rollers 5E are attached to the base piece 15. On the other hand, the sheet presser 5C, the other of the paired rollers 5D, and the other of the paired conveyer rollers 5E are attached to the panel 17. Therefore, when the panel 17 is in the open position, the sheet presser 5C, the other of the paired rollers 5D, and the other of the paired conveyer rollers 5E are moved apart from the image reading element 5B, the one of the paired conveyer rollers 5D, and the one of the paired conveyer rollers 5E, and the conveying path Lo is exposed. Thus, an original sheet jammed in the conveying path Lo can be easily accessed by the user to be removed.

2.2 Detailed Structure of the Auto-Feeder Unit

The original sheet tray 11 is formed on an inclined plane, which is inclined with respect to the horizontal direction. The original sheets to be fed to the reader unit 5 are set on the original sheet tray 11 in a vertically stacked condition. Therefore, when set on the original sheet tray 11, one or more original sheets slide to a lower end of the original sheet tray 11 due to the effect of gravity.

In the vicinity of the lower end of the original sheet tray 11, a separator roller 71 is disposed. The separator roller 71 is disposed on a lower side of the sheet stack along the stacking direction of the original sheets and is arranged to be in contact with a lowermost original sheet in the stack on the original sheet tray 11. When the separator roller 71 rotates with the lowermost original sheet being in contact with the separator roller 71, conveying force is applied to the lowermost original sheet by the rotation. The separator roller 71 is rotatably attached to the base piece 15 and is rotated by driving force generated in an electric motor (not shown).

On an upper side of the sheet stack along the stacking direction of the original sheets, a separator pad 72 is disposed.

The separator pad 72 is arranged to be in contact with the original sheets in a position to face the separator roller 71 across the conveying path Lo (and the original sheet) and applies conveying resistance to the original sheets. The separator pad 72 is made of a resiliently deformable material, such as silicon rubber and urethane rubber, which has greater friction coefficient than the material of the original sheet (e.g., paper).

The separator pad 72 is formed in a shape of an elongated flat plate, which extends from the position to be in contact with the original sheet toward the upstream along the conveying direction. The separator pad 72 is fixed to the panel 17 at an upstream end 72A thereof along the conveying direction. Therefore, the separator pad 72 is fixed to the panel 17 at one of two longitudinal end, i.e., the upstream end 72A, and the other longitudinal end, i.e., a downstream end 72B, and is movable to be closer to or apart from the separator roller 71. Thus, while the separator pad 72 keeps in contact with the original sheets, difference in thickness of the original sheets may be absorbed by the resiliency of the separator pad 72.

Figure 6A:
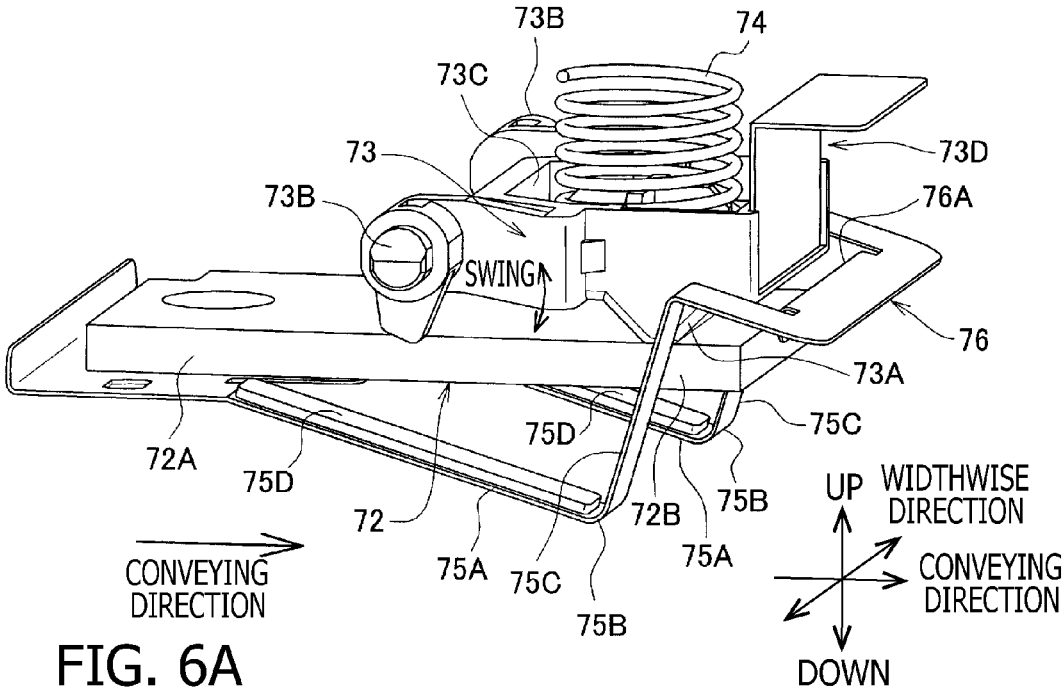
FIG. 6A is an upper perspective view of a separator pad, spring arms, and a movable member in the MFP according to the embodiment of the present invention.
Figure 6B:
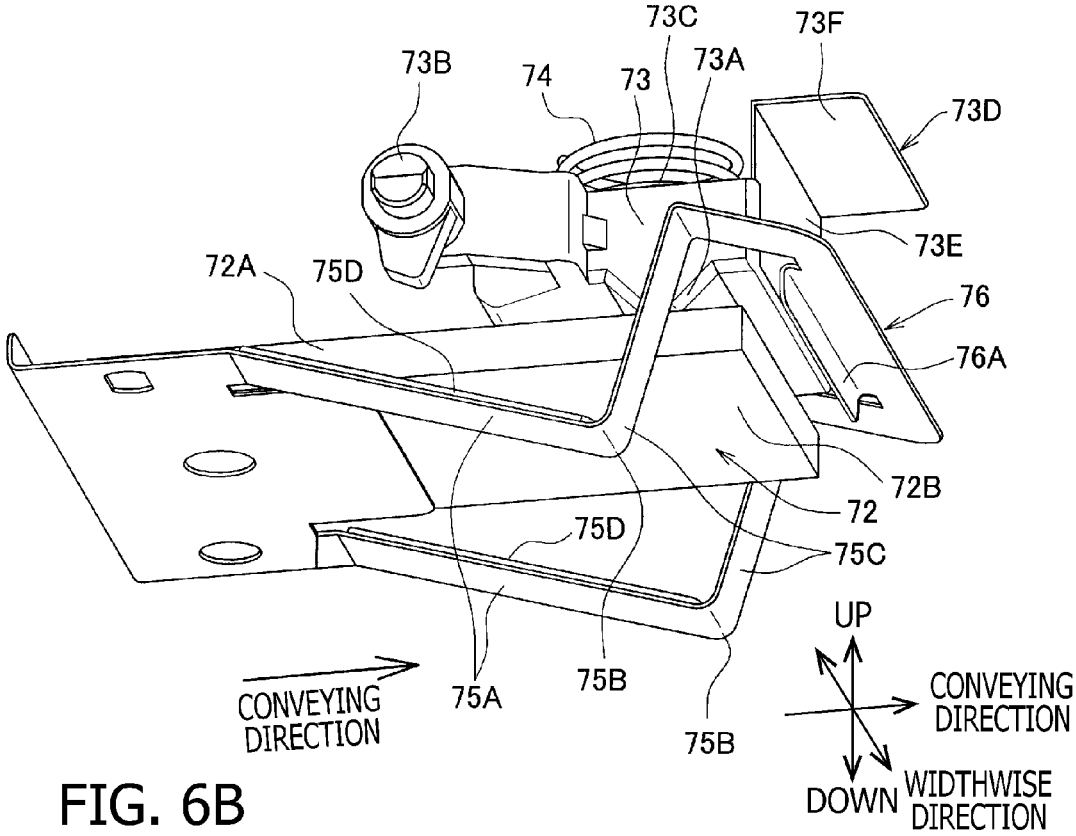
FIG. 6B is a lower perspective view of the separator pad, the spring arms, and the movable member in the MFP according to the embodiment of the present invention.

In a position opposite from the separator roller 71 across the separator pad 72, a movable member 73, which is movable with respect to the separator roller 71, is disposed. The movable member 73 includes, as shown in FIGS. 6A and 6B, a contact section 73A, a swing shaft 73B, and a spring base 73C. The contact section 73A is in contact with the separator pad 72 when the movable member 73 is installed in the auto-feeder unit 7. The swing shaft 73B swingably supports the movable member 73. The spring base 73C is formed in a shape of a box to receive resilient force from a spring 74.

The swing shaft 73B is disposed in an upstream position along the conveying direction with respect to the contact section 73A of the movable member 73. The spring 74 is disposed in a position between the panel 17 and the movable member 73 in a compressed condition. Thus, the spring 74 provides expanding force, which presses the contact section 73A against the separator pad 72, to the movable member 73. Accordingly, the separator pad 72 is pressed toward the separator roller 71.

The swing shaft 73B is attached to a bearing (not shown), which is formed in the panel 17. The contact section 73A, the swing shaft 73B, and the box-shaped spring base 73C are made integrally of resin, such as ABS, PS, and POM, to form the movable member 73.

On both sides of the separator pad 72 along a widthwise direction, a pair of spring arms 75A are disposed. The widthwise direction refers to a direction in parallel with an axis of the swing shaft 73B. In the present embodiment, the widthwise direction is in parallel with a direction, which is orthogonal to the conveying direction and the stacking direction of the original sheets. The spring arms 75A are arranged in an upstream position with respect to a nipping position Pn, in which the separator roller 71 and the separator pad 72 in cooperation with each other nip the original sheet, to be in contact with the original sheet thereat and to press the original sheet toward the separator roller 71.

The paired spring arms 75A are blade springs, of which longitudinal upstream ends along the conveying direction are fixed to the panel 17, extending from the fixed ends toward the downstream along the conveying direction (see FIG. 6B). The spring arms 75A are arranged to be in contact with the original sheets at the downstream end portions along the extending direction thereof.

The spring arms 75A are fixed to the panel 17 along with the separator pad 72 by a removable fastening means (e.g., screws). The spring arms 75A are formed to have curves 75B, which jut toward the separator roller 71 or the original sheet, at the end portions along the extending direction.

Further, the spring arms 75A are formed to have uprising sections 75C, which rise from the curves 75B toward the panel 17, at the downstream ends along the conveying direction. The paired spring arms 75A are connected with each other via a bridge 76, which extends along the widthwise direction to bridge between the uprising sections 75C. In the present embodiment, the paired spring arms 75A and the bridge 76 are formed integrally of a metal, such as spring steel.

On each of the spring arms 75A, an anti-vibration piece 75D made of resin such as PC, PET, etc. is provided. In particular, the anti-vibration piece 75D is attached to the spring arm 75A in a section between the fixed end and the curve 75B on a side opposite from the separator roller 71.

In the movable member 73, meanwhile, a slider piece 73D is disposed at the downstream end of the movable member 73 along the conveying direction in a position corresponding to the bridge 76. The slider piece 73D is a film sheet made of a resiliently-deformable resin, such as PET.

While the movable member 73 is made of a resin, such as POM, which has greater mechanical strength than a different-typed resin of the slider piece 73D, the slider piece 73D is adhered to the movable member 73 with a double-faced adhesive tape or other adhesive agent.

Figure 7:
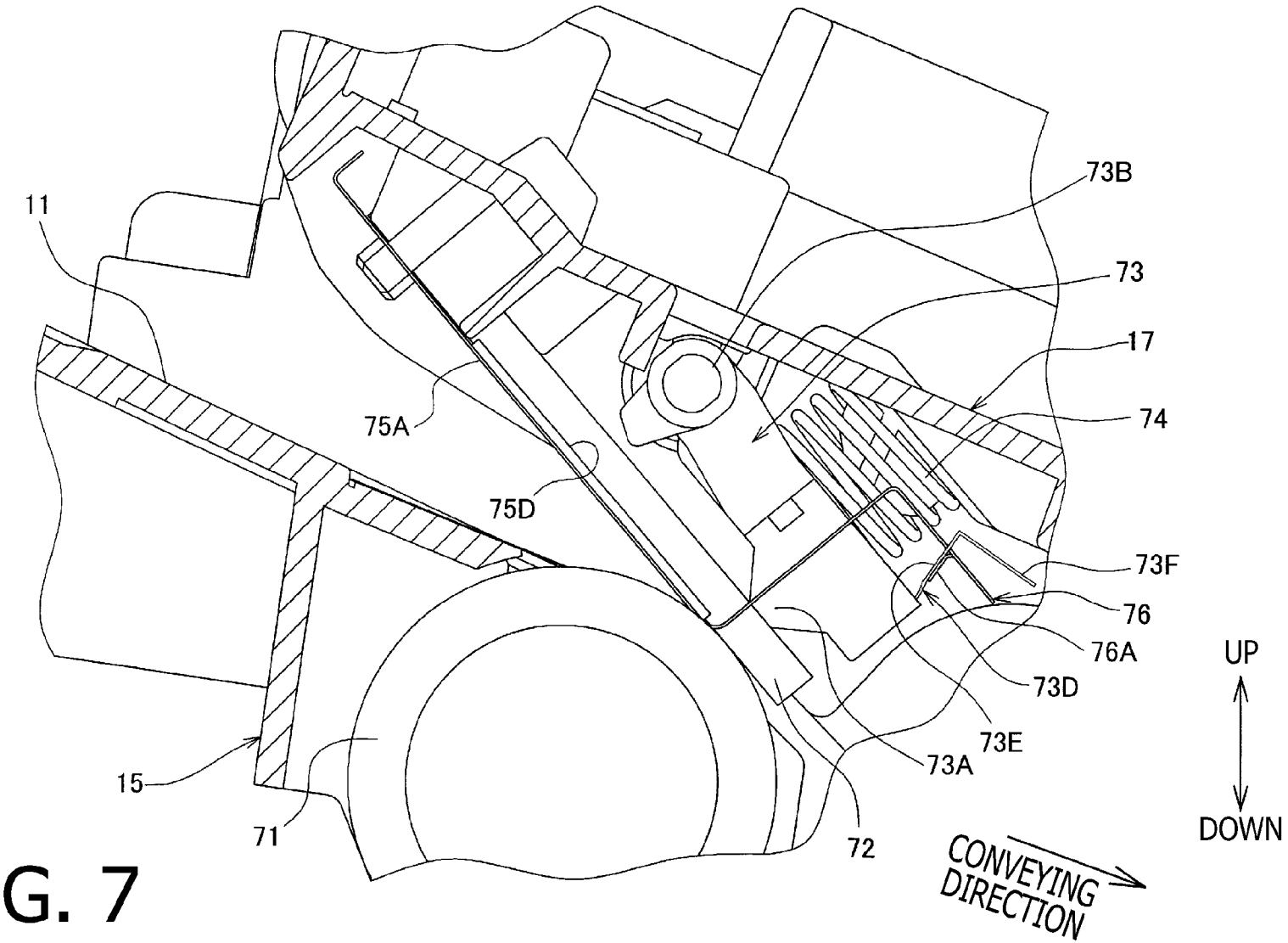
FIG. 7 is an enlarged cross-sectional partial view of the auto-feeder unit in the closed position in the MFP according to the embodiment of the present invention.

When auto-feeder unit 7 is in a conveyable condition, that is, when the panel 17 is in the closed position, in which the original sheets can be fed to the reader unit 5, as shown in FIG. 7, the bridge 76 and the slider piece 73D being a part of the movable member 73 are slidably in contact with each other.

The bridge 76 is provided with a slider plane 76A, in a position to slidably contact the slider piece 73D. More specifically, the bridge 76A is bent at the position to slidably contact the slider piece 73D to integrally form the slider plane 76A.

The slider piece 73D, on the other hand, is formed to have an uprising section 73E and a bent section 73F and has a shape of an "L", when viewed along the widthwise direction. The uprising section 73E rises from a downstream end portion of the movable member 73 in the conveying direction toward the panel 17 (e.g., upward) and is in contact with the slider plane 76A of the bridge 76. The bent section 73 is formed by bending the slider piece 73D at an end portion (e.g., an upper end) of the uprising section 73E along the uprising direction of the uprising section 73E toward the downstream in the conveying direction.

When the panel 17 is in the closed position, in which the original sheets can be fed to the reader unit 5, the end portions of the spring arms 75A in the extending direction and the separator pad 72 being in contact with the separator roller 71 are pressed toward the panel 17. Therefore, the end portions of the spring arms 75A and the contact section 73A of the movable member 73 are urged to be closer to the panel 17 compared to the position of those when the panel 17 is in the open position.

Accordingly, the bridge 76 and the slider plane 76A are placed in upstream positions along the conveying direction with respect to the positions of those when the panel 17 is in the open position. Therefore, the slider piece 73D is placed to be in contact with the slider plane 76A of the bridge 76 in a deformed condition, in which the uprising section 73E is in an upstream position along the conveying direction with respect to the position the uprising section 73E when the panel 17 is in the open position. Thus, when the panel 17 is in the closed position, the slider piece 73D in the movable member 73 and the bridge 76 contact each other with a greater amount of surface pressure in the contact area compared to an amount of surface pressure when the panel 17 is in the open position.

Figure 8:
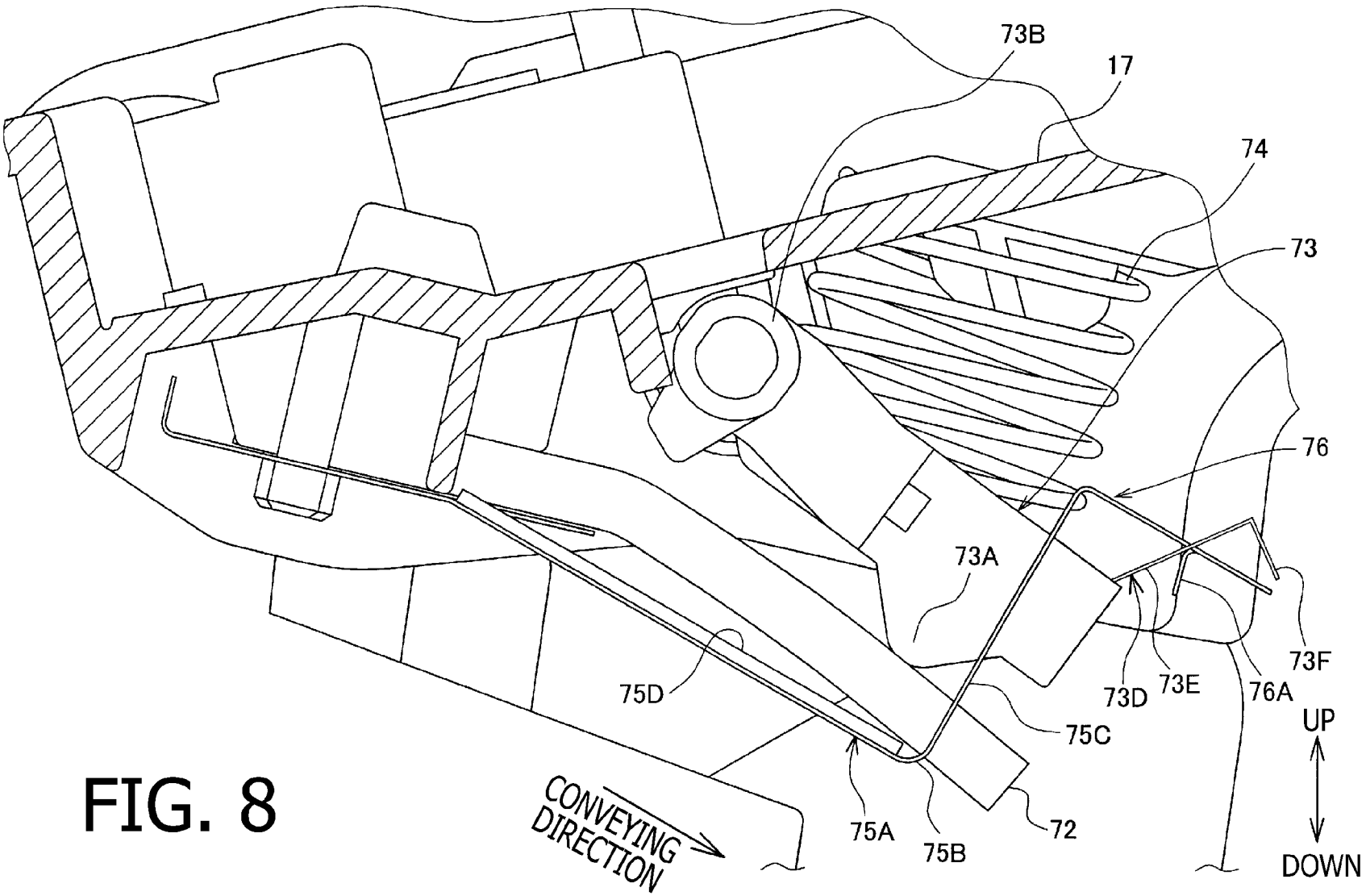
FIG. 8 is an enlarged cross-sectional partial view of the auto-feeder unit in the open position in the MFP according to the embodiment of the present invention.

Meanwhile, even when the panel 17 is in the open position and when the separator pad 72 is separated from the separator roller 71, as shown in FIG. 8, the slider piece 73D in the movable member 73 and the bridge 76 are still in contact with each other, in a smaller contact area.

More specifically, when the panel 17 is in the open position, and the separator pad 72 is separated from the separator roller 71, the spring arms 75A and the spring 74 recover to their original shapes. Therefore, the end portions of the spring arms 75A and the contact section 73A of the movable member 73 are released from the deforming force to be apart from the panel 17 compared to the position of those when the panel 17 is in the closed position.

Accordingly, the bridge 76 and the slider plane 76A are separated from the uprising section 73E of the slider piece 73D to be placed back in the downstream positions along the conveying direction with respect to the positions of those when the panel 17 is in the closed position. Meanwhile, the slider piece 73D is also released from the deforming force of the bridge 76 and recovers back to the downstream position along the conveying direction. Therefore, the contact between the uprising section 73E in the slider piece 73D and the bridge 76 are maintained.

When the panel 17 is in the open position, and the separator pad 72 is separated from the separator roller 71, the uprising section 73E and the slider plane 76A may be separated from each other due to an unexpected reason. However, according to the present embodiment, the uprising section 73E and the bent section 73F are designed to have such shapes and dimension that contact between a surface of the bent section 73F closer to the separator roller 71, i.e., a lower surface of the bent section 73F, and the bridge 76 is maintained, or that the bridge 76 is maintained at a lower position than the lower surface of the bent section 73F.

3. Features of the MFP

It is to be noted, in the present embodiment, that the bridge 76 and the movable member 73 are slidably in contact with each other when the auto-feeder unit 7 is in the condition to convey the original sheets to the reader unit 5.

Therefore, when one of the movable member 73, the separator pad 72, and the spring arms 75A vibrates, the bridge 76 and the movable member 73 slidably move with respect to each other, and the vibration can be absorbed in the slide movement. Accordingly, noise which may be produced in the auto-feeder unit 7 may be reduced.

Further, according to the present embodiment, the part of the movable member 73 to slidably contact the bridge 76 is the slider piece 73D, which is a thinly-formed film sheet. Therefore, the part to contact the bridge 76 can be deformed along the contacting part in the bridge 76, and a greater sliding area between the movable piece 73 and the bridge 76 can be provided.

Therefore, the movable member 73 and the bridge 76 can be placed in the mutually contacting condition steadily, and the vibration in the movable member 73 and the spring arms 75A can be effectively reduced.

Further, according to the present embodiment, the part of the bridge 76 to slidably contact the movable member 73 is formed to have the slider plane 76A, which is a bent-formed part of the bridge 76.

Therefore, the movable member 73 and the bridge 76 can be placed in the mutually contacting condition steadily, and the vibration in the movable member 73 and the spring arms 75A can be effectively reduced.

Furthermore, with the bent-formed slider plane 76A in the bridge 76 to slidably contact with the movable member 73, a second moment of area in the bridge 76 is increased, and bending rigidity of the bridge 76 can be improved.

Therefore, for example, when an original sheet jammed in the auto-feeder unit 7 is to be removed, the original sheet being pulled may be interfered with by the bridge 76, and the bridge 76 may be damaged by the pulling force. However, with the improved bending rigidity, the bridge 76 may be prevented from being deformed or damaged by the original sheet being removed. This feature is specifically advantageous when the bridge 76 is in a thinly-formed structure.

According to the present embodiment, the paired spring arms 75A are provided with the anti-vibration pieces 75D made of a resin. Therefore, a vibration mode in the spring arms 75A is changed, and vibration which may cause a noise in the auto-feeder unit 7 may be reduced.

Further, according to the present embodiment, the anti-vibration pieces 75D are attached to the side opposite from the separator roller 71 in the spring arms 75A. Therefore, interference between the original sheet being conveyed and the anti-vibration pieces 75D is prevented, and the original sheet can be securely conveyed without being interfered with by the anti-vibration pieces 75D.

For example, the movable member 73 and the bridge 76 may be in an arrangement to be separated from each other when the separator pad 72 is separated from the separator roller 71. In such an arrangement, when the movable member 73 and the bridge 76 are moved back to be closer to each other, the movable member 73 and the bridge 76 may not be placed back in the correctly contacting positions with respect to each other.

In the present embodiment, meanwhile, even when the separator pad 72 is separated from the separator roller 71, the movable member 73 and the bridge 76 maintain to be in contact with each other. Thus, the movable member 73 and the bridge 76 can be placed in the preferable condition, in which the movable member 73 and the bridge 76 slidably contact each other.

Further, when the separator pad 72 is separated from the separator roller 71, and even when the uprising section 73E and slider plane 76A are separated from each other, the uprising section 73E and the bent section 73F are configured such that the contact between the lower surface of the bent section 73F and the bridge 76 is maintained, or that the bridge 76 is maintained at the lower position than the lower surface of the bent section 73F. Thus, the movable member 73 and the bridge 76 can be maintained in the preferable condition, in which the movable member 73 and the bridge 76 slidably contact each other.

4. More Examples

Although an example of carrying out the invention has been described, those skilled in the art will appreciate that there are numerous variations and permutations of the auto-feeder device that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the present invention may not necessarily be applied to the auto-feeder unit 7 to convey original sheets but may be applied to a sheet supplying device, which conveys other sheets such as recording sheets.

For another example, the movable member 73 may not necessarily provide the slider piece 73D to be slidably in contact with the bridge 76, but the slider piece 73D may be omitted from the movable member 73.

For another example, the bridge 76 may not necessarily provide the slider plane 76A to be slidably in contact with the movable member 73, but the slider plane 76A may be omitted from the bridge 76.

For another example, the anti-vibration pieces 75D may not necessarily be provided to the spring arms 75A but may be omitted, or may be attached to the uprising sections 75C.

What is claimed is:

1. A sheet feeding device configured to separate a plurality of stacked sheets and convey the separated sheets individually along a conveying direction, comprising:

a roller arranged to be in contact with one of the stacked sheets and configured to rotate on the one of the stacked sheets to apply conveying force to the one of the stacked sheets by rotation;

a separator piece arranged to face the roller and configured to contact the stacked sheets to apply conveying resistance to the stacked sheets and to nip the one of the stacked sheets together with the roller;

a movable member arranged on an opposite side from the roller across the separator piece and configured to be movable with respect to the roller;

a pair of spring arms configured to contact the stacked sheets, at an upstream position along the conveying direction with respect to a nipping position between the roller and the separator piece, to press the stacked sheets toward the roller, each of the spring arms arranged on a respective side of the separator piece along a widthwise direction, the widthwise direction being orthogonal to the conveying direction, to extend along the conveying direction; and a bridge configured to bridge between the pair of spring arms to connect the pair of spring arms, wherein the bridge and the movable member are slidably in contact with each other at least when the sheet feeding device is in a conveyable condition, in which the stacked sheets are conveyable.

2. The sheet feeding device according to claim 1, wherein a part in the movable member configured to slidably contact the bridge is configured with a thinly-formed slidable sheet.

3. The sheet feeding device according to claim 2, wherein the slidable sheet is a film sheet made of resin.

4. The sheet feeding device according to claim 1, wherein a part in the bridge configured to slidably contact the movable member is bent to form a slider plane, on which the movable member slidably contacts the bridge.

5. The sheet feeding device according to claim 1, wherein the movable member and the bridge maintain contact with each other even when the separator piece is separated from the roller.

6. The sheet feeding device according to claim 1, wherein the movable member is swingable about an upstream portion thereof along the conveying direction;

wherein the pair of spring arms are fixed at an upstream portion thereof along the conveying direction to extend downstream along the conveying direction;

wherein the bridge is arranged at downstream end portions of the pair of spring arms along an extending direction of the pair of spring arms; and wherein the bridge is configured to be slidably in contact with a downstream part of the movable member along the conveying direction.

7. The sheet feeding device according to claim 1, wherein the pair of spring arms are provided with resin-made anti-vibration members.

8. An image reading apparatus, comprising:

a reader unit configured to read an image appearing on an original sheet; and a sheet feeding device configured to separate a plurality of stacked original sheets and convey the separated sheets individually along a conveying direction to the reader unit, wherein the sheet feeding device comprises:

a roller arranged to be in contact with one of the stacked sheets and configured to rotate on the one of the stacked sheets to apply conveying force to the one of the stacked sheets by rotation;

a separator piece arranged to face the roller and configured to contact the stacked sheets to apply conveying resistance to the stacked sheets and to nip the one of the stacked sheets in cooperation with the roller;

a movable member arranged on an opposite side from the roller across the separator piece and configured to be movable with respect to the roller;

a pair of spring arms configured to contact the stacked sheets at an upstream position, along the conveying direction with respect to a nipping position between the roller and the separator piece, to press the stacked sheets toward the roller, each of the spring arms arranged on a respective side of the separator piece along a widthwise direction, the widthwise direction being orthogonal to the conveying direction, to extend along the conveying direction; and a bridge configured to bridge between the pair of spring arms to connect the pair of spring arms, wherein the bridge and the movable member are slidably in contact with each other at least when the sheet feeding device is in a conveyable condition, in which the stacked sheets are conveyable.

* * * * *